US006183371B1

(12) United States Patent
Wethered

(10) Patent No.: US 6,183,371 B1
(45) Date of Patent: Feb. 6, 2001

(54) REPLACEABLE CUE TIP SYSTEM

(75) Inventor: William Merline Wethered, Washougal, WA (US)

(73) Assignees: Pamela Gene Wethered-McClung; David William McClung, both of Maple Valley, WA (US)

( * ) Notice: Under 35 U.S.C. 154(b), the term of this patent shall be extended for 0 days.

(21) Appl. No.: 08/882,483

(22) Filed: Jun. 25, 1997

Related U.S. Application Data

(60) Provisional application No. 60/022,012, filed on Jun. 25, 1996.

(51) Int. Cl.[7] ..... A63D 15/08
(52) U.S. Cl. ..... 473/46; 473/44
(58) Field of Search ..... 473/44–51

(56) References Cited

U.S. PATENT DOCUMENTS

| | | | |
|---|---|---|---|
| 338,888 | 3/1886 | Tracy . | |
| 583,009 | 5/1897 | Cunningham . | |
| 803,420 * | 10/1905 | Koegel | 473/51 |
| 860,381 | 7/1907 | Holden . | |
| 934,162 | 9/1909 | Gormon . | |
| 1,077,664 | 11/1913 | Ankenmann . | |
| 1,141,587 | 6/1915 | Smith . | |
| 1,476,622 | 12/1923 | Kirk . | |
| 1,544,696 | 7/1925 | Sprenkel . | |
| 1,565,612 * | 12/1925 | Ajello | 473/49 |
| 1,614,414 | 2/1927 | Vargo . | |
| 2,544,970 | 3/1951 | Watson | 273/70 |
| 3,226,119 | 12/1965 | Foy | 273/70 |

FOREIGN PATENT DOCUMENTS

| | | |
|---|---|---|
| 20222 | 5/1905 | (DE) . |
| 573159 | 6/1924 | (FR) . |
| 785662 | 8/1935 | (FR) . |
| 150651 | 9/1920 | (GB) . |

* cited by examiner

*Primary Examiner*—Mickey Yu
*Assistant Examiner*—Denise Pothier
(74) *Attorney, Agent, or Firm*—R. Reams Goodloe, Jr.

(57) ABSTRACT

A cue tip mounting system. A system for releasably securing a leather cue tip to a cue stick is provided. The system provides a tip mount for permanent mounting in the distal end of a cue stick. The tip mount has a threaded shaft extending outward along central axis for releasable threaded engagement with interior threads provided in a detachable mounting ferrule. The mounting ferrule has, at the tip end thereof, a centrally located nipple with flat distal surface for providing a centering force on a leather tip which is adhesively bonded to the tip end of the mounting ferrule. The tip is provided with a nipple accepting cup adapted to receiving the centering nipple protruding from the in the mounting ferrule. Preferably, the tip mount is provided in brass, and the ferrule in brass or aluminum, for absorbing shock.

9 Claims, 4 Drawing Sheets

PRIOR ART

REPLACEABLE CUE TIP SYSTEM

This application claims benefits of provisional application 60/022,012 filed Jun. 25, 1996.

FIELD OF THE INVENTION

My invention relates to a system for reliably mounting cue tips, and more particularly, to a unique, particularized, cooperative design configuration which provides reliable, yet replaceable cue tips for pool or billiard cue sticks.

BACKGROUND

Users of cue sticks have for years been faced with the problem of how to simply yet reliably replace the tip of the cue when it begins to wear to an undesirable extent. Over the years, as reproduceable machine parts and advanced adhesives have become available, various cue replacement systems have been devised which enable the user to maintain use of a favorite cue stick by having a worn out cue tip replaced. Some of the systems known to me have been susceptible to undesirable problems, including inadequate strength in various joints. Often, in current designs, there is a tendency to split the cue stick when the stick is used for a shot where high compressive forces are applied to the tip and cue, such as a during break shot. Other systems are sufficiently complicated that it is difficult to provide the parts inexpensively enough to interest large segments of the market for such devices. As a consequence, there is still an unmet need for improvements over the apparatus and methods which have been used heretofore for replacement of cue tips.

SUMMARY OF THE INVENTION

I have now invented, and disclose herein, a novel configuration for attachment of cue tips to cue sticks. The system is especially adapted for the replaceable attachment of a cue tip to a cue stick of preselected length. A permanently mountable tip mount is first affixed to the distal end of the cue stick. The tip mount has a cue side and a ferrule side, and includes a generally C-shaped central disk portion, having an annular shaped edge portion which forms a cap ring along the periphery of the cue side. The tip mount is also provide with a central mounting shaft extending from the center of the tip mount in the cue side direction for a length $L_{66}$, adapted to fit into a centered borehole in the cue shaft. On the tip side of the tip mount, a ferrule attachment shaft is provided. The ferrule attachment shaft extends from the center of the tip mount in the tip direction for a length $L_{90}$. The ferrule attachment shaft is threaded for receiving a ferrule which has, on the cue end, a centrally located internal thread adapted for threaded engagement with the ferrule attachment shaft. The ferrule is adapted to be securely and releasably affixed to the ferrule attachment shaft of the tip mount. A leather cue tip is adhesively bonded to the tip side of the removable ferrule. Ideally, the tip side of the ferrule also includes a centrally located nipple portion which protrudes outwardly from the tip end of the ferrule, and the tip has a back including a nipple receiving cup defined at the radially outward reaches thereof by a central peripheral edge. Preferably, the nipple includes a flat central land to provide a stable centering force to the cue tip upon impact with a ball.

OBJECTS, ADVANTAGES, AND NOVEL FEATURES

I have now invented, and disclose herein, a novel system for providing replaceable cue tips. My system does not have the drawbacks common to those somewhat similar products heretofore used of which I am aware. Unlike the earlier designs, the components of my system are simple, lightweight, relatively inexpensive and easy to manufacture, and otherwise superior to those designs heretofore used or proposed. In addition, my system provides a significant, additional measure of ease in repeatedly replacing a cue tip.

From the foregoing, it will be apparent to the reader that one important and primary object of the present invention resides in the provision of a novel system for replacement of cue tips.

Other important but more specific objects of the invention reside in the provision of a simple cue tip replacement system as described herein which:

- provides a strong cue tip which is highly resistant to shear;
- provides apparatus for joining a tip to a cue stick in a manner which does not transmit compressive strain to the cue stick in a fashion which tends to deform or split the cue stick;
- can be manufactured in a simple, straightforward manner of strong, resilient, breakage resistant materials; and
- in conjunction with the preceding object, have the advantage that they can be quickly and easily serviced to provide a reliable, replaceable cue tip.

Other important objects, features, and additional advantages of my invention will become apparent to the reader from the foregoing and as the ensuing detailed description and discussion proceeds in conjunction with the accompanying drawing.

Figure 1:
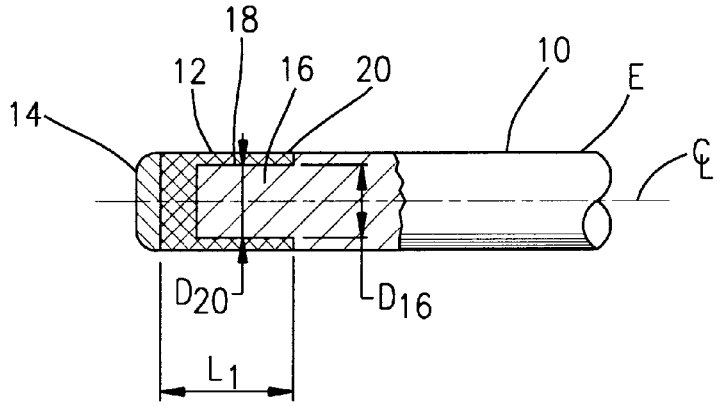
FIG. 1 is a cross sectional view of a prior art cue tip attachment system.

Like parts will be shown in the various figures via use of identical numbers, without further mention thereof. Also, at various places in the description, certain diameters are mentioned at locations which are implicitly referenced along a centerline of the drawing, and without otherwise identifying the location on the drawings, and it is to be understood that such diameters are with respect to diameters perpendicular to the centerlines shown in the various drawings and at the referenced line, unless otherwise shown or indicated.

DESCRIPTION

Attention is directed to FIG. 1 of the drawing wherein a prior art cue stick 10 is shown finished with a replaceable ferrule 12 attached thereto, and to which a leather tip 14 is adhesively joined. Such systems require use of a lathe to form a cylindrical tenon 16 in cue stick 10. A cylindrical face surface 18 on tenon 16 of outside diameter $D_{16}$ is provided complementary in size to the inside diameter $D_{20}$ of cap portion 20 of ferrule 12. Importantly, since the ferrule 12 is glued to tenon 16, each time a tip 14 is replaced, the cue stick 10 is shortened by a length $L_1$ sufficient to enable formation of a new tenon (like tenon 16, but not shown), for affixing a new ferrule 12' (like ferrule 12, but not shown) to cue stick 10. This system and the parts used as just described will result, over time, in an unacceptable shortening of the cue stick 10.

Figure 2:
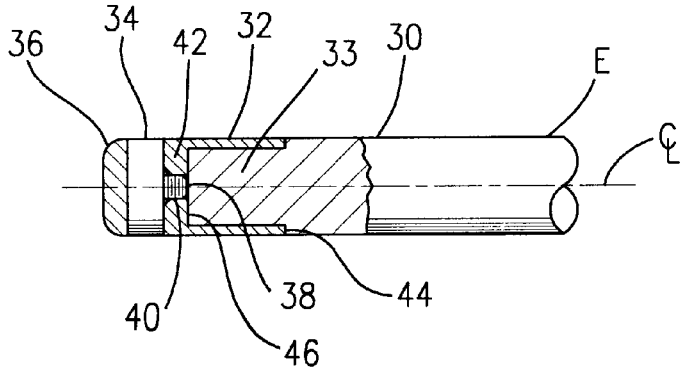
PRIOR ART FIG 2
FIG. 2 is a cross sectional view of a second prior art cue tip attachment system.

A similar, but somewhat improved prior art system is shown in FIG. 2, where an "Adams Import" brand type of cue replacement system is shown. In that system, a cue stick 30 is provided with a permanent, usually brass ferrule 32 attached to tenon 33 in the manner described above. A replaceable tip base 34 is provided, and the tip base 34 has adhesively attached thereto a leather tip 36. The tip base 34 has a screw fastener 38 which fits into screw receiving threads 40 in the end body 42 of permanent ferrule 32. This system avoids repeated shortening of cue stick 30 as new tips are provided, since only the tip base 34 and accompanying leather tip 36 are replaced.

Both of the above disclosed cue tip replacement systems have drawbacks. In the first system described, the cue stick 10 will inevitably be shortened over time, resulting in the need for increasingly larger diameter ferrules 12 to allow attachment to cue stick 10 at a smooth joint. Also, neither design provides a uniform compressive force to the cue sticks 10 or 30, and thus, in time, such sticks may tend to split to reflect the shearing motion between differing compressive forces imparted along the outer edge E and along the centerline $C_L$ of cue sticks 10 or 30, for example by peripheral end 44 and interior end 46 of permanent ferrule 32.

Figure 3:
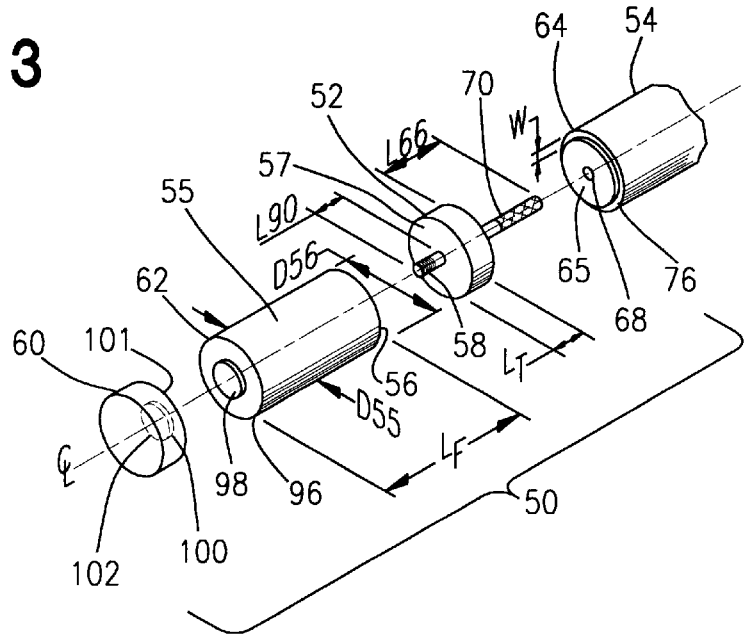
FIG. 3 is an exploded perspective view of my novel cue tip attachment system, showing a leather tip, a joining ferrule, a mount, and the distal end of a cue stick.
Figure 4:
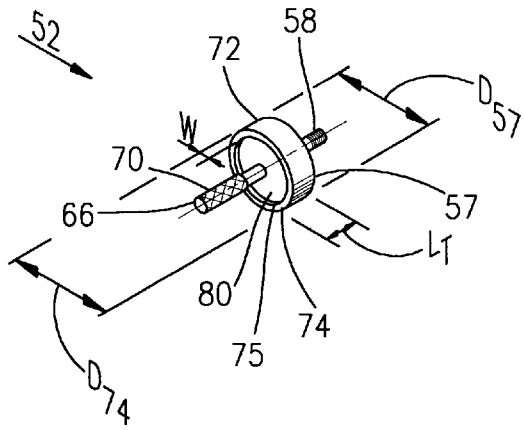
FIG. 4 is a perspective view of the back side of a mount which is permanently affixed to a cue stick and which is then used to join a mounting ferrule to the cue stick.

Turning now to FIG. 3, my novel replaceable tip system components 50 are shown in an expanded perspective view. A tip mount 52 is provided for permanent attachment to the cue stick 54. A ferrule 55 having a cue or rear end 56 of diameter $D_{56}$ that is complementary in size to the front 57 of tip mount 52 of diameter $D_{57}$, is provided with a fastener, preferably threads 58, for detachable fastening engagement with the tip mount 52. A tip 60, preferably leather, is fixedly attached to ferrule 55, preferably with a high quality adhesive, to the tip end 62 of ferrule 55.

Figure 5:
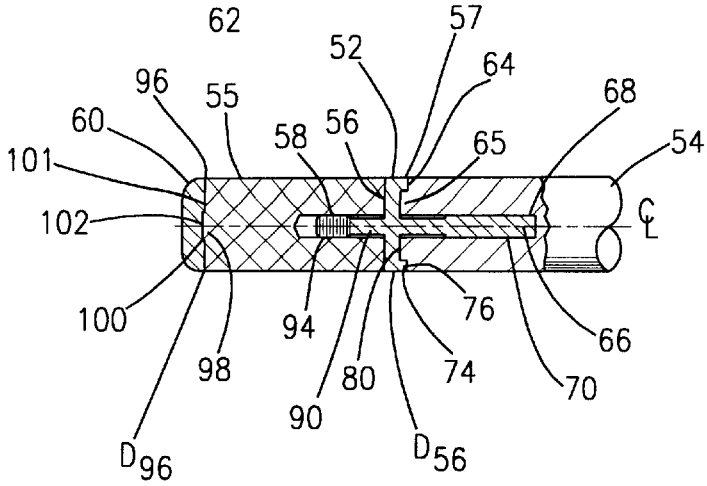
FIG. 5 is a cross sectional view of a fully assembled cue stick with detachable tip, shown with the tip affixed using a detachable ferrule.

Further specifics of each component of my replaceable cue tip system 50 are important because they provide a clear performance improvement over prior art cue tip fastening systems. The permanent tip mount 52 is ideally provided in a relatively soft, somewhat shock absorbing (compressive impact absorbing) metal, preferably brass. Also, tip mount 52 is preferably provided in one piece, as is evident in cross-section as illustrated in FIG. 5, so that it provides sufficient stiffness against lateral movement of the components of the system 50, once the tip mount 52 is securely mounted in cue stick 54. Tip mount 52 is adhesively bonded to the distal edge end 64 and distal central end 65 of cue stick 54. The tip mount 52 has a mounting shaft 66 for tight fitting insertion into, and adhesive bonded within, borehole 68 which is provided along the centerline $C_L$ of cue stick 54. To increase friction and security of the tip mount 52 when it is affixed in place, the outer surface 70 of mounting shaft 66 is roughened, preferably with a knurled type surface as shown. Ideally, tip mount 52 is affixed in place in borehole 68 in the cue 54 with the assistance of a high strength glue, such as Devcon, manufactured by ITW Brands of Wooddale, Ill., and sold under Universal Product Number 0-7814320845-4. The combination of epoxy and the knurled outer surface 70 results in a super strong bond of the tip mount 52 to cue stick 54.

Tip mount 52 is ideally provided with a central disk portion 72 which is generally C-shaped in cross-section, the tips of the C being formed by an inwardly extending shaped edge portion 74 of width W and having a face 75 complementary to the side of distal edge end 64 of cue 54. This shaped edge portion 74 is ideally provided in the shape of an annulus with outer diameter $D_{74}$, which diameter is the same as diameter as the outer diameter $D_{76}$ of cue 54 at corner 76, which corner defines the start of distal edge end 64 in cue 54. Radially inward from the annular shaped edge portion 74 of tip mount 52 is a smooth, force transferring portion 80, preferably oriented transverse to the center line of the cue 54, so that force may be transferred uniformly and directly along the center line $C_L$ of cue 54.

The distal edge end 64 of cue 54 is sized and shaped to receive face 75 of shaped edge portion 74 of tip mount 52. Likewise, the distal central end 65 is sized and shaped to receive the force transferring portion 80 of tip mount 52. The ability of the tip mount 52 to uniformly and reliably transmit force to the cue 54 is an important improvement in the art.

A ferrule 55 is provided for mounting to tip mount 52 via shaft portion 90. Exterior threads 58 on shaft portion 90, complementary to interior threads 94 in ferrule 55, matingly engage to removably and securely affix ferrule 55 to the tip mount 52. The ferrule 55 handle end diameter $D_{56}$ is the same as diameter $D_{57}$ of tip mount 52, so as to match the tip mount 52 size. However, the diameter $D_{55}$ of the ferrule 55 may vary along its length, generally, so that at the distal end 96 of ferrule 55, the actual diameter $D_{96}$ is less than $D_{56}$. The ferrule 55 also has provided at its distal end 96 a centrally located nipple 98 which increases the centering force transmitted to the tip 60. A central peripheral edge 100 in the back 101 of tip 60 defines a nipple receiving cup 102 in tip 60 adapted to receive in complementary mating engagement the nipple 98 of ferrule 55. The tip 60 is preferably affixed to an aluminum or brass ferrule 55 with a suitable high strength glue. One suitable two part epoxy formulation which provides excellent results is available from J B Weld, and sold under Universal Product Number 043425826558. This combination of structural design and bonding provides a highly shear resistant leather tip 60 which is securely mounted on a cue stick 54.

Figure 6:
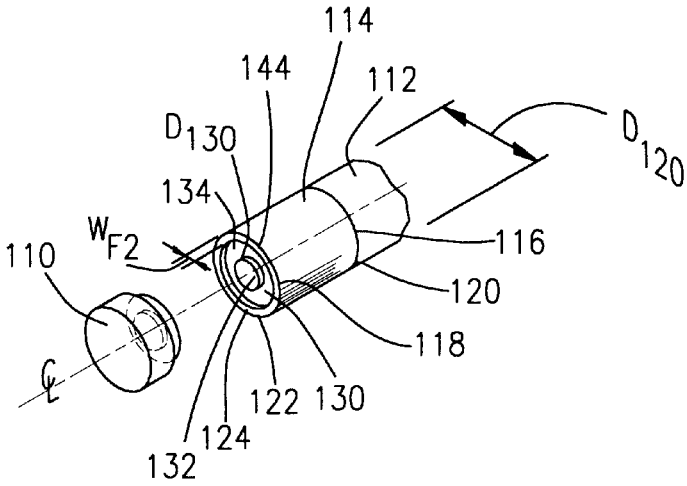
FIG. 6 shows a second embodiment of my ferrule and and leather tip design.
Figure 7:
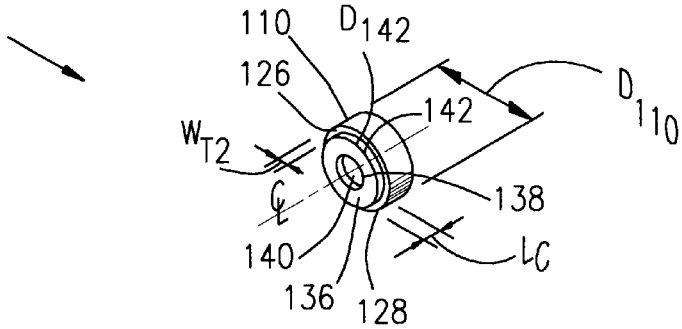
FIG. 7 provides in a back side view of the leather tip design first illustrated in FIG. 6, showing the large annular area provided for cushioning impact.
Figure 8:
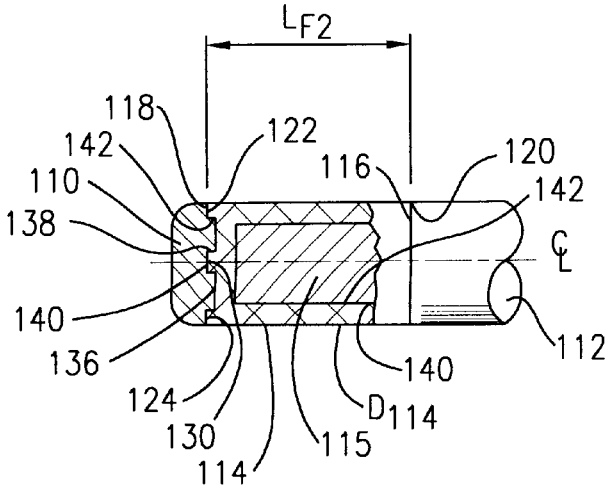
FIG. 8 illustrates, fully assembled, the second embodiment of my ferrule and leather tip design as just illustrated in FIGS. 6 and 7 above.

Turning now to FIGS. 6, 7, and 8, another embodiment of my system for affixing tips 110 to cue sticks 112 is illustrated. A permanent mounting ferrule 114 is attached to cue stick 112 via high strength adhesive bond to a substantially cylindrical tenon 115. The ferrule 114 extends between a first, cue end 116 and a second, tip end 118, along a length $L_{F2}$. A corner 120 on cue 112 defines the outer peripheral end of cue 112, and at a that point, the cue 112 has a diameter $D_{120}$. At the tip end 118, a thin outer annular cap ring 122 of width $W_{F2}$ is provided; in many applications, width $W_{F2}$ of about 1/16 inch is adequate. The thin cap ring 122 has a tip side face 124 sized to fit, in complementary fashion a receiving land 126 in the back 128 of tip 110. Along the centerline $C_L$ of the ferrule 114, a protruding nipple 130 of diameter $D_{130}$ with flat compression land 132 is provided, transverse to centerline $C_L$.

Between the cap ring 122 and the nipple 130, an annular shaped force transferring portion 134 is provided, preferably oriented transverse to the centerline $C_L$ of the cue 112. This force receiving portion is sized complementary to the annular cushion portion 136 provided on the back 129 of tip 110. Also, note that the inner edge 138 of annular cushion portion 136 defines a nipple receiving cup 140 of diameter $D_{136}$ which is preferably complementary to diameter $D_{130}$ of nipple 130, so that the nipple 130 is securely and fully received in cup 140.

Outer edge 142 of annular cushion portion 136 defines a diameter $D_{142}$ that is complementary in size to inner edge 144 of the thin annular ring cap 122 in ferrule 114. The difference between diameter $D_{142}$ and the outer diameter $D_{110}$ of tip 110 defines the width $W_{T2}$ of receiving land 126. Length $L_c$ defines the thickness of annular cushion portion 136, and approximately 1/16 inch is adequate length $L_c$ in many applications. The configuration just illustrated for the annular cap ring 122 and the annular cushion portion 136 is important since the cap effectively captures the cushion portion 136, substantially preventing the tip 110 from spreading after repeated impacts. This construction is of substantial benefit in preventing the tip 110 from shearing away.

For mounting, ferrule 114 is provided with outside diameter $D_{114}$, and with an inner surface 140 of inner diameter $D_{140}$. The ferrule 114 is tightly fitted over the circular cross section, and preferably cylindrical outer wall 142 of diameter $D_{142}$ of tenon 115. Also, it should be understood that this embodiment is equally suitable for retrofit of existing ferrules, by machining of existing ferrules to provide a suitable annular cap ring 122, as it is for mounting of new ferrules.

Figure 9:
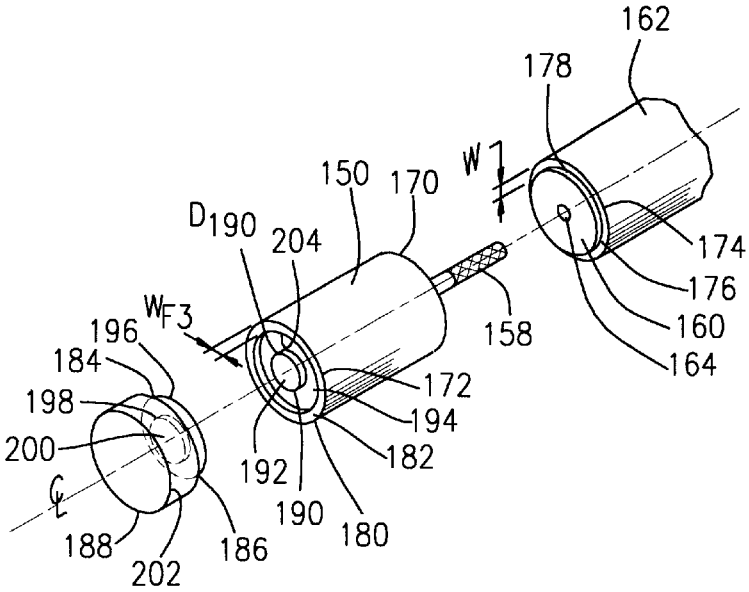
FIG. 9 illustrates still another embodiment of my tip attachment system, where the ferrule permanently mounts to the cue, and where the large annular area is provided on a leather tip for cushioning impact.
Figure 10:
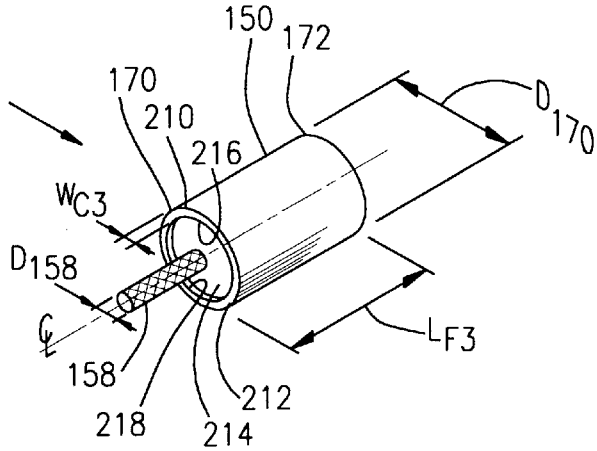
FIG. 10 shows details of the design of the ferrule just set forth in FIG. 9.
Figure 11:
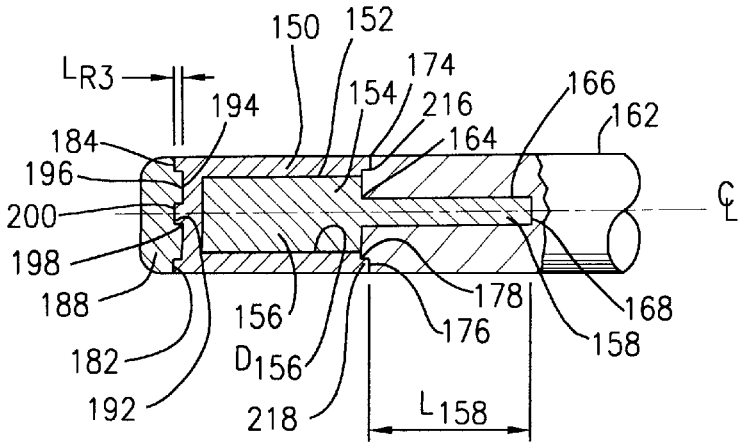
FIG. 11 illustrates the fully assembled components in one embodiment of my tip mounting system, namely a leather tip with large annular cushion area, and a permanently mounted ferrule, of the type just set forth in FIGS. 9 and 10 above.

Finally, turning to FIGS. 9, 10, and 11, another embodiment of my tip mounting system is provided. In this embodiment, my peripheral cap ring system is used in both the attachment of a permanent mounting ferrule 150 to a cue 162, and in the attachment of a leather tip 188 to the permanent mounting ferrule 150. This is important, since the advantages of the cap ring system work in both situations to enhance service life of the combination for mounting tip 188 to cue 162.

In my mounting system, a ferrule 150 is provided with a central bore 152 of diameter $D_{152}$, into which is inserted a tight fitting wooden plug 154 that is preferably substantially cylindrical, and basically paddle shaped in cross-section. The plug 154 has a bottom portion 156 with outer diameter $D_{156}$. A preferably integrally provided mounting shaft 158 of length $L_{158}$ with outer diameter $D_{158}$ is provided. The distal central end 160 of cue 162 has drilled therein, and extending inwardly along the centerline thereof, a borehole defined by entry 164, interior edge 166, and interior end wall 168. The borehole is at least as long as, and preferably sized substantially complementary to, the length $L_{158}$ and diameter $D_{158}$ of mounting shaft 158.

The ferrule 150 extends between a first, cue end 170 and a second, tip end 172, along a length $L_{F3}$. A corner 174 on cue 162 defines the outer peripheral end of cue 162, and at a that point, the cue 112 has a diameter $D_{174}$. A land 176 extends radially inwardly from corner 174 to endwall 178.

At the tip end 172 of ferrule 150, a thin outer peripheral annular cap ring 180 of width $W_{F3}$ is provided. In many applications, width $W_{F3}$ of about 1/16 inch is adequate, and a corresponding depth $L_{R3}$ of about 1/16 inch is adequate. The thin peripheral cap ring 180 has a tip side face 182 sized to fit, in complementary fashion, a receiving land 184 in the back 186 of tip 188. Along the centerline $C_L$ of the ferrule 150, a protruding nipple 190 of diameter $D_{190}$ with flat compression land 192 is provided, transverse to centerline $C_L$.

Between the cap ring 180 and the nipple 190, an annular shaped force transferring portion 194 is provided, preferably oriented transverse to the centerline $C_L$ of the cue 162. This force transferring portion 194 is sized complementary to the annular cushion portion 196 provided on the back 186 of tip 188. Also, note that the inner edge 198 of annular cushion portion 196 defines a nipple receiving cup 200 of diameter $D_{198}$ which is preferably complementary to diameter $D_{190}$ of nipple 190, so that the nipple 190 is securely and fully received in cup 200.

Outer edge 202 of annular cushion portion 196 defines a diameter $D_{202}$ that is complementary in size to inner edge 204 of the thin annular cap ring 180 in ferrule 150. The difference between outer diameter $D_{150}$ and the inner diameter $D_{204}$ of ring 180 defines the width $W_{F3}$ of face 182. Length $L_{R3}$ defines the depth of the force transferring portion 194; approximately 1/16 inch is adequate length $L_{R3}$ in many applications. The configuration just illustrated for the annular peripheral ring cap 180 and the annular cushion portion 196 is important since the cap ring 180 effectively captures the annular cushion portion 196, substantially preventing the tip 188 from spreading after repeated impacts. This construction is of substantial benefit in preventing the tip 188 from shearing away.

In FIG. 10, the cue end 170 of ferrule 150 is depicted, and it can be appreciated that the annular ring cap type construction is also featured. Here, at the cue end 170 of ferrule 150, a thin outer peripheral annular cue end cap ring 210 of width $W_{C3}$ is provided. In many applications, width $W_{C3}$ of about 1/16 inch is adequate, and a corresponding depth $L_{R3}$ of about 1/16 inch is adequate. The thin peripheral cue end cap ring 210 has a tip side face 212 sized to fit, in complementary fashion, a receiving land 176 in cue 162. Along the centerline $C_L$ of the ferrule 150, the mounting shaft 158 protrudes.

Between the cue end cap ring 210 and the mounting shaft 158, an annular shaped cue end force transferring portion 214 is provided, preferably oriented transverse to the centerline $C_L$ of the cue 162. This force transferring portion 214 is sized complementary to the distal central end 160 of cue 162. Also, note that the inner edge 216 of the cue end annular cap ring 210 defines an inner surface 218 complementary to the mating surface 178 of cue 162. The configuration just illustrated for the cue end peripheral ring cap 210 and the distal central end 160 of cue 162 is important since the cue end cap ring 210 effectively captures most of the distal end of cue 162 inside of inner edge 216, thus substantially preventing the cue 162 from splitting after repeated impacts. Said another way, the cue end ring cap 210 effectively prevents the wood in the distal end of the cue 162 from spreading radially outward upon impact, thus preventing breakage of fiber and disbanding or splitting of the wood. Thus, this construction is of substantial benefit in preventing the cue 162 from splitting during repeated high compression usage.

It is to be appreciated that the replaceable cue tip system disclosed herein is a significant improvement in the state of the art of replaceable cue tip systems. My novel replaceable cue tip system is relatively simple, and it substantially improves the reliability of replaceable cue tip systems on billiard and pool cues.

It will thus be seen that the objects set forth above, including those made apparent from the proceeding description, are efficiently attained, and, since certain changes may be made in carrying out the construction of a suitable apparatus to produce the desired joint for attachment of a cue tip to a cue stick, it is to be understood that the invention may be embodied in other specific forms without departing from the spirit or essential characteristics thereof. For example, while I have set forth exemplary designs for improved attachment ferrules, many other embodiments are also feasible to attain the result of the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed.

The intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

We claim:

1. A cue tip attachment system for replaceable attachment of a cue tip to a cue stick, the cue stick having a handle end, a distal end, and longitudinal axis, said system comprising:

(a) an integral, one-piece tip mount, said tip mount having a cue side and a ferrule side, said tip mount further comprising
  (i) a generally C-shaped central disk portion, said central disk portion comprising
    (A) an annular shaped axial center edge portion on said cue side, said annular shaped edge portion having a face portion, and
    (B) an impact-absorbing flat front on said ferrule side;
  (ii) a central mounting shaft, said central mounting shaft extending from the center of said tip mount in the cue side direction for a length ($L_{66}$),
  (iii) a ferrule attachment shaft, said ferrule attachment shaft extending from the center of said tip mount on the ferrule side for a length ($L_{90}$), said ferrule attachment shaft having threads thereon;

(b) a ferrule, said ferrule having a cue end, a tip end, and a length ($L_F$) therebetween with outer surface of substantially circular cross-section, said ferrule further comprising an interior mounting shaft receiving bore having internal threads therein adapted to securely and releasably receive said threads of said ferrule attachment shaft of said tip mount, and wherein said flat front of said ferrule side of said integral one-piece tip mount lies flush against said cue end of said ferrule.

2. The cue tip attachment system set forth in claim 1, further comprising a cue tip, said cue tip adhesively attached to said ferrule.

3. The cue tip attachment system set forth in claim 1, wherein said tip end of said ferrule further comprises a centrally located nipple portion, said nipple portion protruding outwardly from said tip end of said ferrule.

4. The cue tip attachment system as set forth in claim 3, further comprising a cue tip, and wherein said cue tip has a back, and wherein said back further comprises a central nipple receiving cup.

5. The cue tip attachment system as set forth in claim 4, wherein said cue tip comprises a central pripheral edge defining said nipple receiving cup.

6. The cue tip attachment system as set forth in claim. 1, wherein said generally C-shaped central disk portion of said tip mount further comprises a force transferring portion, said force transferring portion extending radially outward from said central mounting shaft to said annular shaped edge portion of said tip mount.

7. The cue tip attachment system as set forth in claim 6, wherein said force transferring portion is provided in a flat surface oriented transverse to said longitudinal axis of said cue stick.

8. The combination of a cue stick and a cue stick attachment system, said combination comprising:

(a) a cue stick, said cue stick comprising a shaft of preselected length with a central, longitudinal axis therealong, said cue stick having a handle end and a distal end, said distal end further comprising
  (i) an annular shaped distal edge end;
  (ii) an annular shaped distal central end; and
  (iii) a central borehole, said central borehole extending into said shaft along said central longitudinal axis for a predetermined distance, said predetermined distance at least of distance ($L_{66}$);

(b) an integral, one-piece tip mount, said tip mount having a cue side and a ferrule side, said tip mount further comprising
  (i) a central disc portion having a generally C-shaped cross-sectional shape, said central disk portion comprising
    (A) an annular shaped edge portion along said cue side, said annular shaped edge portion having a face portion, and
    (B) an impact-absorbing flat front on said ferrule side;
  (ii) a central mounting shaft, said central mounting shaft extending from the center of said tip mount in the cue side direction for a length ($L_{66}$),
  (iii) a ferrule attachment shaft, said ferrule attachment shaft extending from the center of said tip mount on the ferrule side for a length ($L_{90}$), said ferrule attachment shaft having threads thereon;

(c) a ferrule, said ferrule having a cue end, a tip end, and a length ($L_F$) therebetween with outer surface of substantially circular cross-section, said ferrule further comprising an interior mounting shaft receiving bore having internal threads therein adapted to securely and releasably receive said threads of said ferrule attachment shaft of said tip mount, and wherein said flat front of said ferrule side of said integral one-piece tip mount liles flush against said cue end of said ferrule;

(d) and wherein said annular shaped distal edge end of said cue stick is is securely affixed to said face portion of said annular shaped edge portion of said tip mount.

9. The combination as set forth in claim 8, wherein said cue stick further comprises a central borehole, said central borehole extending into said shaft along said central longitudinal axis for a predetermined distance, said borehole adapted to accommodate said central mounting shaft of said tip mount for adhesive bonding of said cue to said tip mount.

* * * * *